US008800689B2

(12) United States Patent
Crawford

(10) Patent No.: US 8,800,689 B2
(45) Date of Patent: Aug. 12, 2014

(54) FLOATING PLUG PRESSURE EQUALIZATION IN OILFIELD DRILL BITS

(71) Applicant: Halliburton Energy Services, Inc., Houston, TX (US)

(72) Inventor: Michael B. Crawford, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/705,658

(22) Filed: Dec. 5, 2012

(65) Prior Publication Data

US 2013/0153304 A1 Jun. 20, 2013

(30) Foreign Application Priority Data

Dec. 14, 2011 (WO) ..... PCT/US2011/064945

(51) Int. Cl.

| | |
|---|---|
| ***E21B 10/25*** | (2006.01) |
| ***E21B 10/24*** | (2006.01) |
| ***E21B 10/60*** | (2006.01) |
| ***E21B 10/00*** | (2006.01) |

(52) U.S. Cl.

CPC ..... *E21B 10/60* (2013.01); *E21B 10/24* (2013.01); *E21B 10/00* (2013.01)

USPC ..... 175/228; 175/227; 175/371

(58) Field of Classification Search

USPC ..... 175/228, 227, 232, 318, 371

See application file for complete search history.

(56) References Cited

U.S. PATENT DOCUMENTS

| | | | | |
|---|---|---|---|---|
| 3,866,695 | A | 2/1975 | Jackson | |
| 4,386,667 | A | 6/1983 | Millsapps, Jr. | |
| 4,453,836 | A * | 6/1984 | Klima | 384/94 |
| 5,027,911 | A * | 7/1991 | Dysart | 175/57 |
| 5,441,120 | A * | 8/1995 | Dysart | 175/228 |
| 5,918,688 | A | 7/1999 | Evans | |
| 6,041,857 | A | 3/2000 | Carmody et al. | |
| 6,196,339 | B1 * | 3/2001 | Portwood et al. | 175/371 |
| 6,206,110 | B1 | 3/2001 | Slaughter, Jr. et al. | |
| 6,364,023 | B1 | 4/2002 | Hiron et al. | |
| 6,431,293 | B1 | 8/2002 | Portwood et al. | |
| 6,602,059 | B1 | 8/2003 | Howell et al. | |
| 6,688,860 | B2 | 2/2004 | Du et al. | |
| 6,802,380 | B2 * | 10/2004 | Blackman | 175/228 |

(Continued)

FOREIGN PATENT DOCUMENTS

WO 97-30269 A1 8/1997

OTHER PUBLICATIONS

Office Action issued Apr. 26, 2013 for U.S. Appl. No. 13/742,886, 13 pages.

(Continued)

*Primary Examiner* — Shane Bomar
*Assistant Examiner* — Wei Wang
(74) *Attorney, Agent, or Firm* — Smith IP Services, P.C.

(57) ABSTRACT

A drill bit of the type used to drill a wellbore in the earth can comprise a bore formed in the drill bit, and a plug sealingly and reciprocably disposed in the bore, whereby the plug prevents fluid communication between sections of the bore in the drill bit. The plug can comprise a spherically-shaped member. The plug can comprise a floating plug sealingly and reciprocably disposed in the bore, whereby pressure in the different sections of the bore on respective opposite sides of the plug is substantially equalized.

7 Claims, 10 Drawing Sheets

(56) References Cited

U.S. PATENT DOCUMENTS

| | | | | |
|---|---|---|---|---|
| 7,373,983 | B2 | 5/2008 | McGavern, III et al. | |
| 2002/0108747 | A1 | 8/2002 | Dietz et al. | |
| 2002/0108788 | A1 * | 8/2002 | Peterson et al. | 175/228 |
| 2006/0118304 | A1 | 6/2006 | Ohmer | |
| 2008/0053662 | A1 | 3/2008 | Williamson et al. | |
| 2010/0051260 | A1 | 3/2010 | Vick, Jr. et al. | |
| 2011/0024111 | A1 | 2/2011 | Moen et al. | |
| 2012/0103619 | A1 | 5/2012 | Schroeder et al. | |

OTHER PUBLICATIONS

Office Action issued Apr. 26, 2013 for U.S. Appl. No. 13/718,951, 16 pages.

Specification and Drawings for U.S. Appl. No. 13/718,951, filed Dec. 18, 2012, 64 pages.

International Search Report with Written Opinion issued Sep. 24, 2012 for PCT Patent Application No. PCT/US11/064945, 12 pages.

International Search Report with Written Opinion issued Sep. 25, 2012 for PCT Patent Application No. PCT/US11/066514, 14 pages.

Search Report issued Sep. 24, 2012 for International Application Ser. No. PCT/US11/64945, 6 pages.

Written Opinion issued Sep. 24, 2012 for International Application Serial No. PCT/US11/64945, 6 pages.

Office Action issued Oct. 9, 2013 for U.S. Appl. No. 13/742,886, 18 pages.

* cited by examiner

FLOATING PLUG PRESSURE EQUALIZATION IN OILFIELD DRILL BITS

CROSS-REFERENCE TO RELATED APPLICATION

This application claims the benefit under 35 USC §119 of the filing date of International Application Serial No. PCT/US11/64945, filed 14 Dec. 2011. The entire disclosure of this prior application is incorporated herein by this reference.

BACKGROUND

This disclosure relates generally to equipment utilized and operations performed in drilling of subterranean wells and, in an example described below, more particularly provides floating plug pressure equalization in drill bits of the type used to drill wellbores in the earth.

Lubricant is used in drill bits for various purposes, among which is to exclude well fluids and debris from interfaces between components of the drill bits that move relative to one another. For example, lubricant can be used between cones of a tri-cone bit and journals on which the cones rotate.

Preferably, the lubricant is maintained at a pressure which is substantially equal to that in its environment, so that seals which isolate the lubricant from well fluids in the environment do not have to withstand significant pressure differentials in use. Therefore, it will be appreciated that improvements are continually needed in the art of pressure equalization for drill bits.

DETAILED DESCRIPTION

Figure 1:
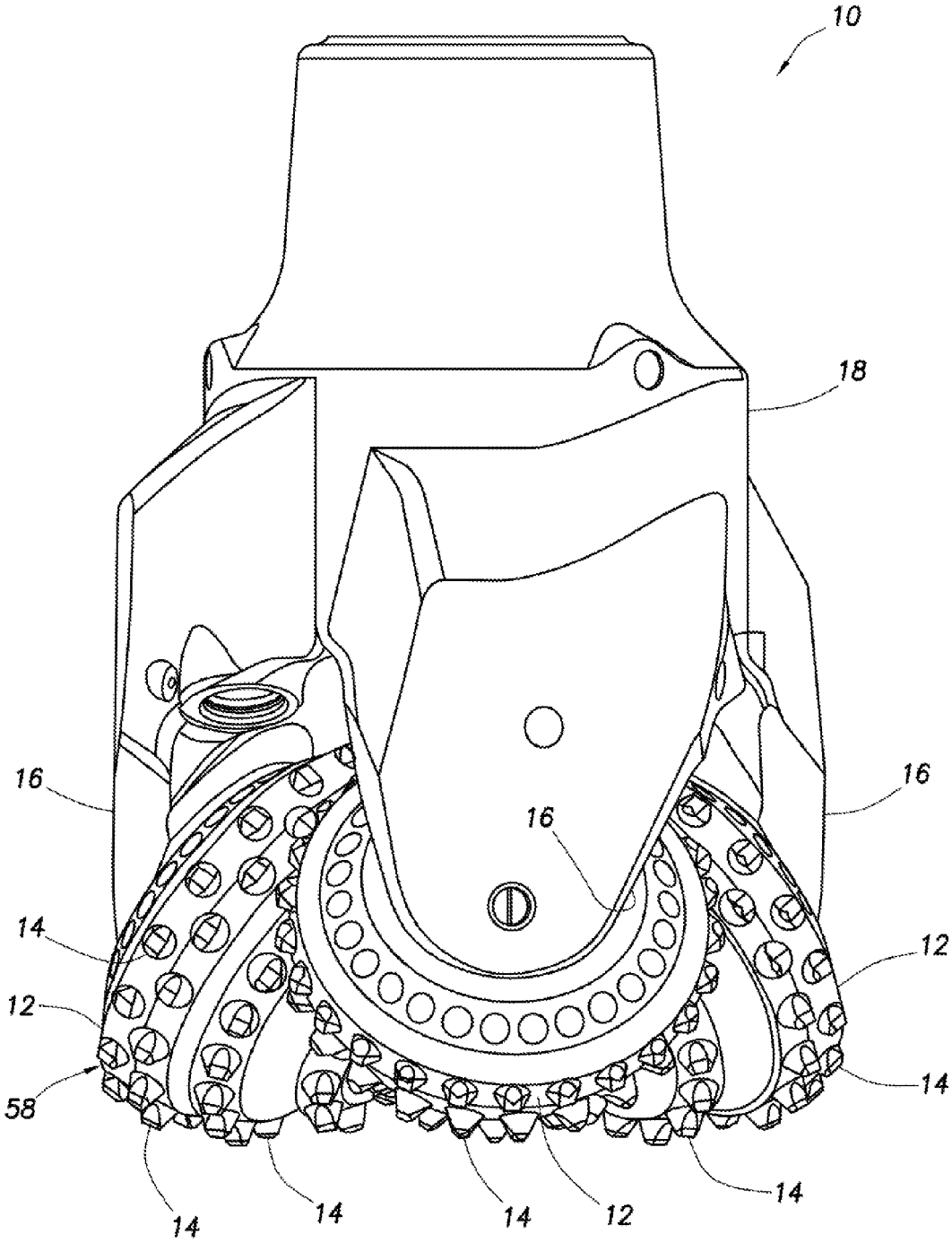
FIG. 1 is a representative side view of a drill bit which can embody principles of this disclosure.

Representatively illustrated in FIG. 1 is a drill bit 10 which can embody principles of this disclosure. The drill bit 10 is of the type known to those skilled in the art as a roller cone bit or a tri-cone bit, due to its use of multiple generally conical-shaped rollers or cones 12 having earth-engaging cutting elements 14 thereon.

Each of the cones 12 is rotatably secured to a respective arm 16 extending downwardly (as depicted in FIG. 1) from a main body 18 of the bit 10. In this example, there are three each of the cones 12 and arms 16.

However, it should be clearly understood that the principles of this disclosure may be incorporated into drill bits having other numbers of cones and arms, other types of cutting structures (e.g., not necessarily cones and cutting elements) and other types of drill bits and drill bit configurations. The drill bit 10 depicted in FIG. 1 is merely one example of a wide variety of drill bits which can utilize the principles described herein.

Figure 2:
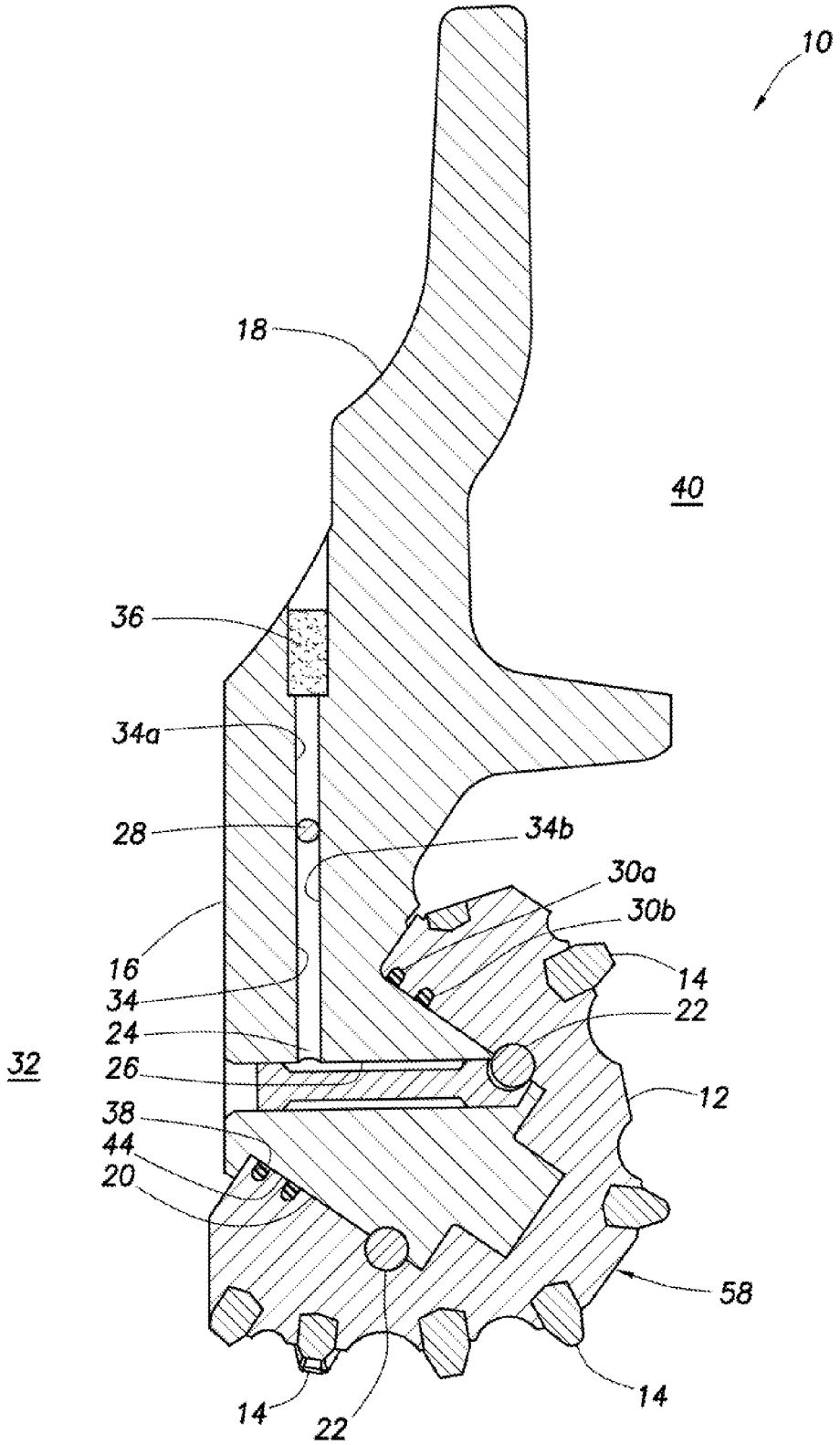
FIG. 2 is a representative cross-sectional view of a body of the drill bit.

Referring additionally now to FIG. 2, a cross-sectional view of one of the arms 16 is representatively illustrated. In this view it may be seen that the cone 12 rotates about a journal 20 of the arm 16. Retaining balls 22 are used between the cone 12 and the journal 20 to secure the cone on the arm.

Lubricant is supplied to the interface between the cone 12 and the journal 20 from a lubricant chamber 24 via a passage 26. A floating plug 28 ensures that the lubricant is at substantially the same pressure as the downhole environment on an exterior 32 of the drill bit 10, when the drill bit is being used to drill a wellbore.

Seals 30*a,b* are used to prevent debris and well fluids from entering an annular gap 44 formed radially between the cone 12 and the journal 20, and to prevent escape of the lubricant from the annular gap and chamber 24. The seals 30*a,b* are received in glands or grooves 38 formed in the cone 12. Although two seals 30*a,b* are depicted in the drawings, any number of seals (including one) may be used in keeping with the scope of this disclosure.

As the cone 12 rotates about the journal 20, the seals 30*a,b* preferably rotate with the cone and seal against an outer surface of the journal. However, in other examples, the seals 30*a,b* could remain stationary on the journal 20 (e.g., the seals being disposed in grooves formed on the journal), with the cone 12 rotating relative to the journal and seals.

In the FIG. 2 example, the floating plug 28 is spherically-shaped, and may comprise a full sphere, although a circumferential portion which contacts a bore 34 in which the plug is reciprocably received may be flattened somewhat. For example, the plug 28 could be made entirely or at least exteriorly of an elastomer or other resilient material, which will deform somewhat when it sealingly contacts the bore 34.

A retainer and/or filter 36 prevents the plug 28 from being discharged out of the bore 34, and filters well fluid which enters one section 34*a* of the bore 34. Another section 34*b* of the bore 34 comprises part of the lubricant chamber 24. The sections 34*a,b* of the bore 34 are isolated from fluid communication with each other by the plug 28.

One benefit of the plug 28 being spherically-shaped is that the plug can rotate within the bore 34 without binding, and while maintaining sealing engagement with the bore. However, in other examples, the plug 28 can have other shapes, such as, cylindrical, barrel-shaped, etc. Any shape may be used for the plug 28 in keeping with the scope of this disclosure.

Note that, instead of providing fluid communication between the section 34*a* and the exterior 32 of the bit 10 (e.g., via the retainer/filter 36), fluid communication could be provided with an interior 40 of the drill bit (e.g., via a passage from the filter/retainer to the interior). In practice, the interior 40 will generally be filled with drilling fluid pumped from a rig mud pump, and the exterior 32 will comprise an annulus formed between the drill bit 10 and a wellbore.

Thus, the lubricant chamber 24 can be pressure equalized with either the exterior 32 or interior 40 of the drill bit 10. Friction between the plug 28 and a wall of the bore 34 contacted by the plug can cause some variation in pressure between the sections 34*a,b* of the bore 34, but it is preferred that the plug will displace in the bore to relieve all but the smallest of pressure differentials across the plug.

With pressure substantially equalized between the sections 34*a,b* of the bore, it will be appreciated that a pressure across the seals 30*a,b* is also substantially zero, since the seals are exposed to the lubricant on one side, and are exposed to the exterior 32 of the drill bit 10 on an opposite side. However, pressure in the annular gap 44 between the two seals 30*a,b* is not necessarily equalized with either the lubricant chamber 24, or the exterior 32 or interior 40 of the drill bit 10, and so a pressure differential can still exist across each of the seals in the example depicted in FIG. 2. In other examples described below, pressure across each of the seals can be substantially equalized, using the principles of this disclosure.

Figure 3:
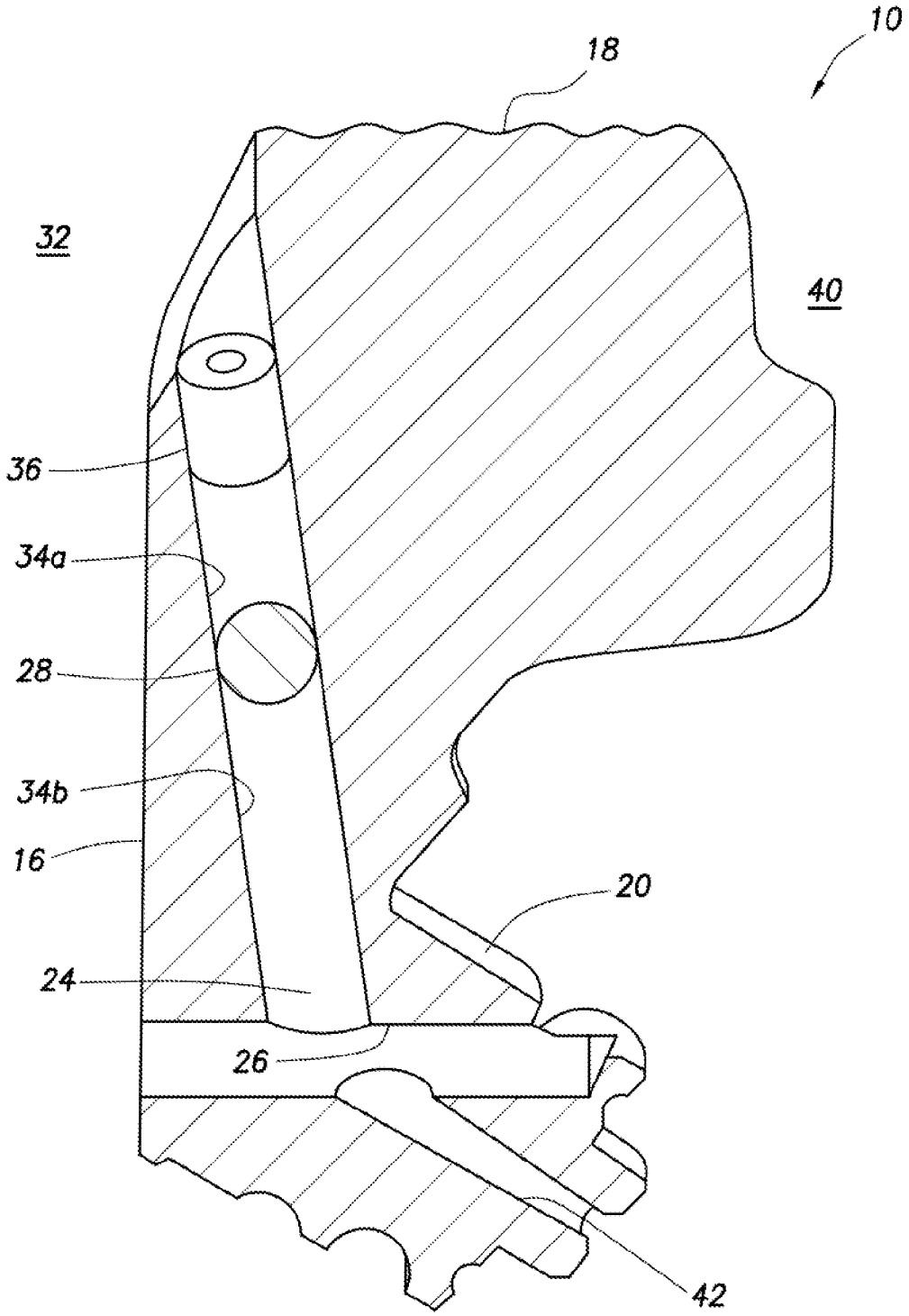
FIG. 3 is a representative oblique cross-sectional view of an arm of another example of the drill bit.

Referring additionally now to FIG. 3, another configuration of the arm 16 is representatively illustrated in an oblique cross-sectional view, with the cone 12 and retaining balls 22 removed for clarity. In this configuration, the retainer 36 does not include a filter, but a filter could be provided, if desired. In addition, another passage 42 extends to a lower end of the journal 20 for enhanced supply of lubricant to the interface between the journal and the cone 12.

Figure 4:
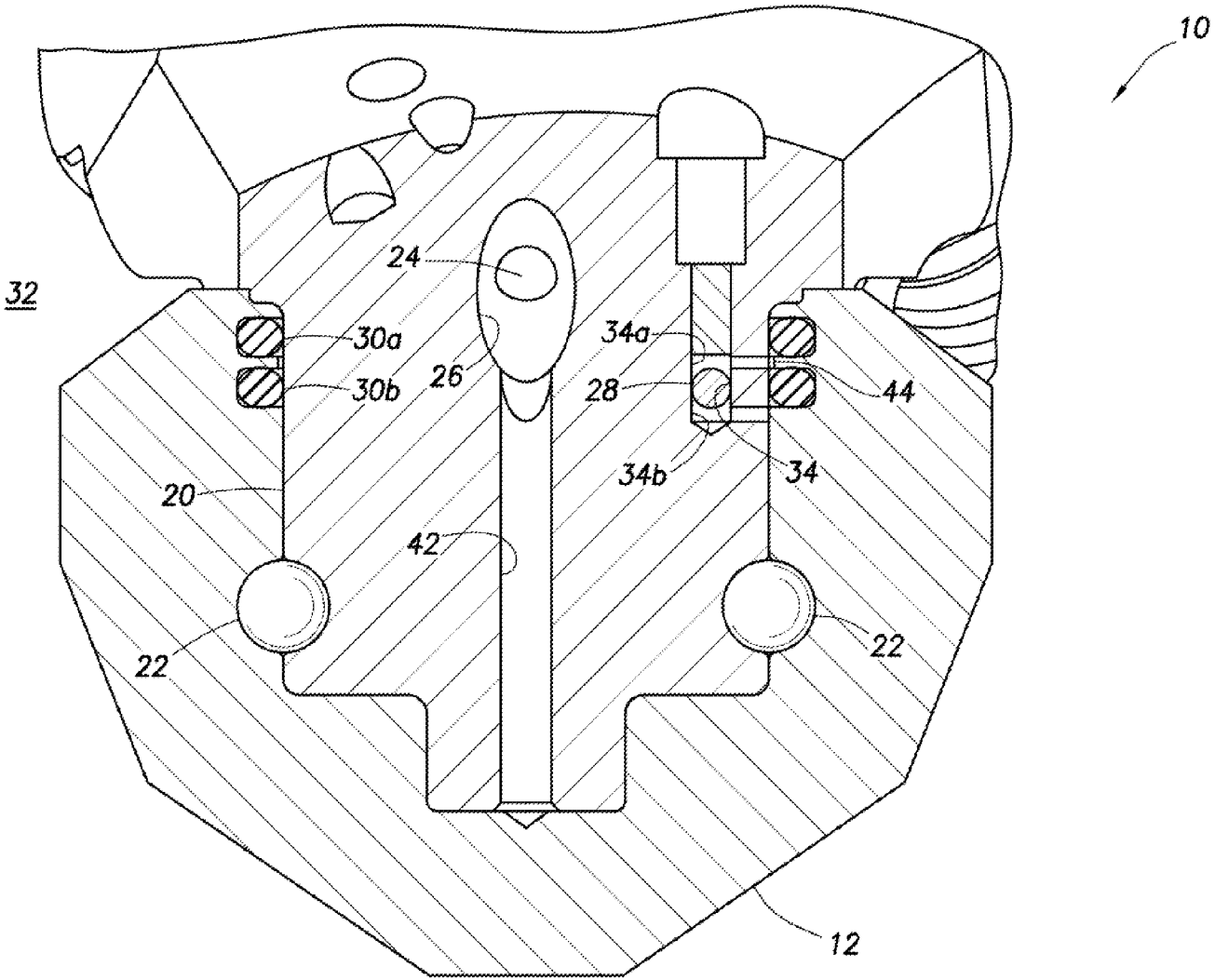
FIGS. 4-8 are representative cross-sectional views of additional examples of the drill bit.

Referring additionally now to FIG. 4, another configuration of the arm 16 is representatively illustrated. In this configuration, pressure across the seal 30*b* is equalized using a floating plug 28, similar to the manner in which the floating plug is used in the FIGS. 2 & 3 configuration. Note that a conventional pressure equalization device (such as, a diaphragm or membrane, etc.) is preferably used with the configuration of FIG. 4 for equalization of pressure between the lubricant chamber 24 and the exterior 32 of the drill bit 10.

In the FIG. 4 example, the plug 28 provides for equalization of pressure across one of the seals 30*b*, thereby also substantially equalizing pressure across each of the seals 30*a,b*, while also preventing leakage through the annular gap 44, even if one of the seals should fail. For example, even if the seal 30*a* should fail, the other seal 30*b* and the plug 28 will still prevent well fluid from flowing into the lubricant chamber 24 via the annular gap 44.

In the FIG. 4 configuration, pressure across the seal 30*b* is equalized, one side of the seal 30*b* is exposed to pressure in the lubricant chamber 24 (e.g., via the passages 26, 42), an opposite side of the seal 30*b* is exposed to the annular gap 44, pressure in the lubricant chamber 24 is equalized with pressure on the exterior 32 of the drill bit 10 (e.g., using a conventional pressure equalization device, or using the plug 28 and bore 34 of FIGS. 2 & 3, etc.), one side of the seal 30*a* is exposed to the annular gap, and an opposite side of the seal 30*a* is exposed to pressure on the exterior 32 of the drill bit 10, it follows that pressures on both sides of each of the seals 30*a,b* are substantially equalized with pressure on the exterior of the bit. Thus, neither of the seals 30*a,b* has a substantial pressure differential across it.

Figure 5:
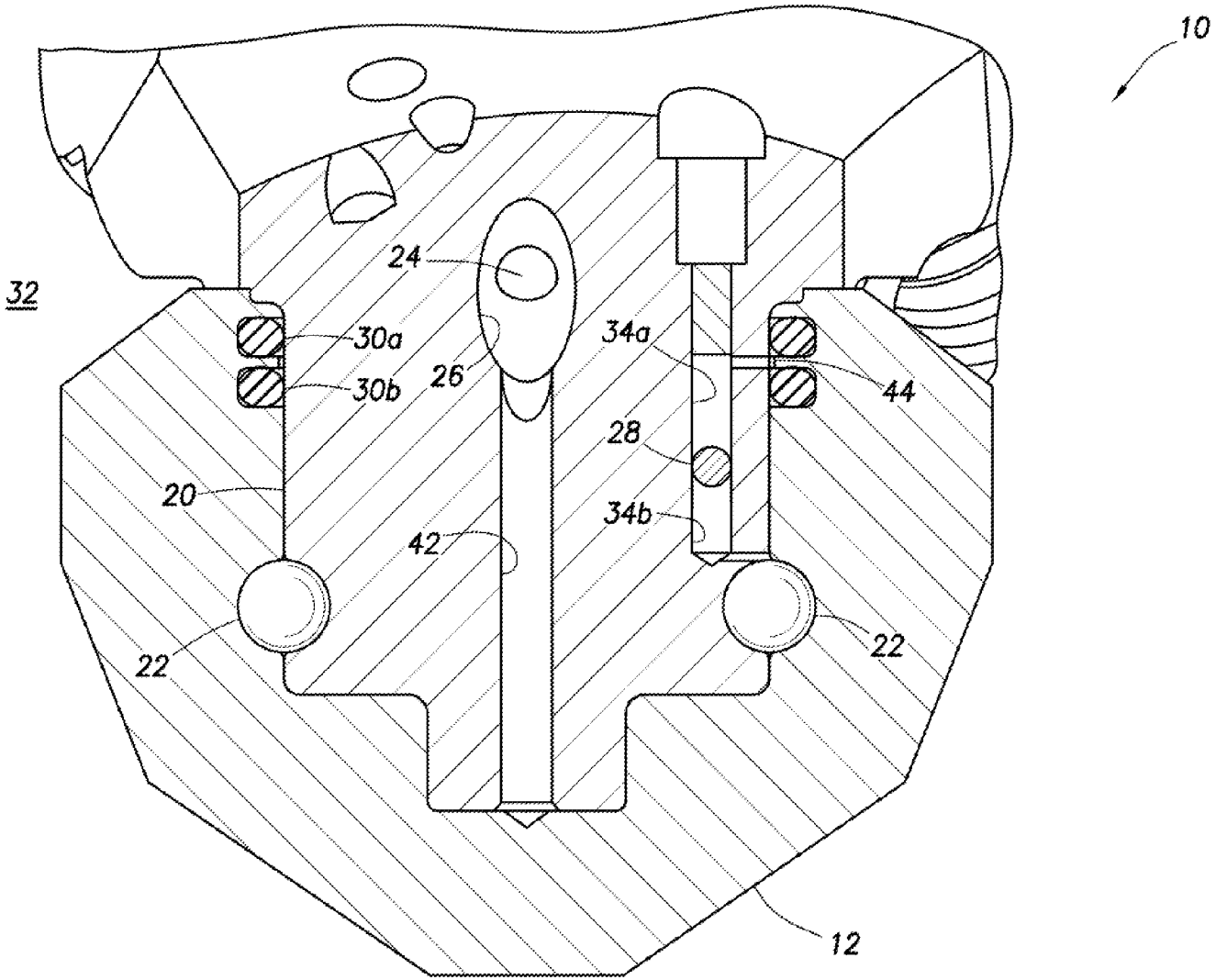

Referring additionally now to FIG. 5, another configuration of the drill bit 10 is representatively illustrated. In this configuration, the bore sections 34*a,b* are extended, thereby providing further available displacement of the plug 28. This, in turn, provides more initial volume for the lubricant, more volume for thermal expansion of the lubricant, and/or more volume for compression of the lubricant at downhole pressures.

Figure 6:
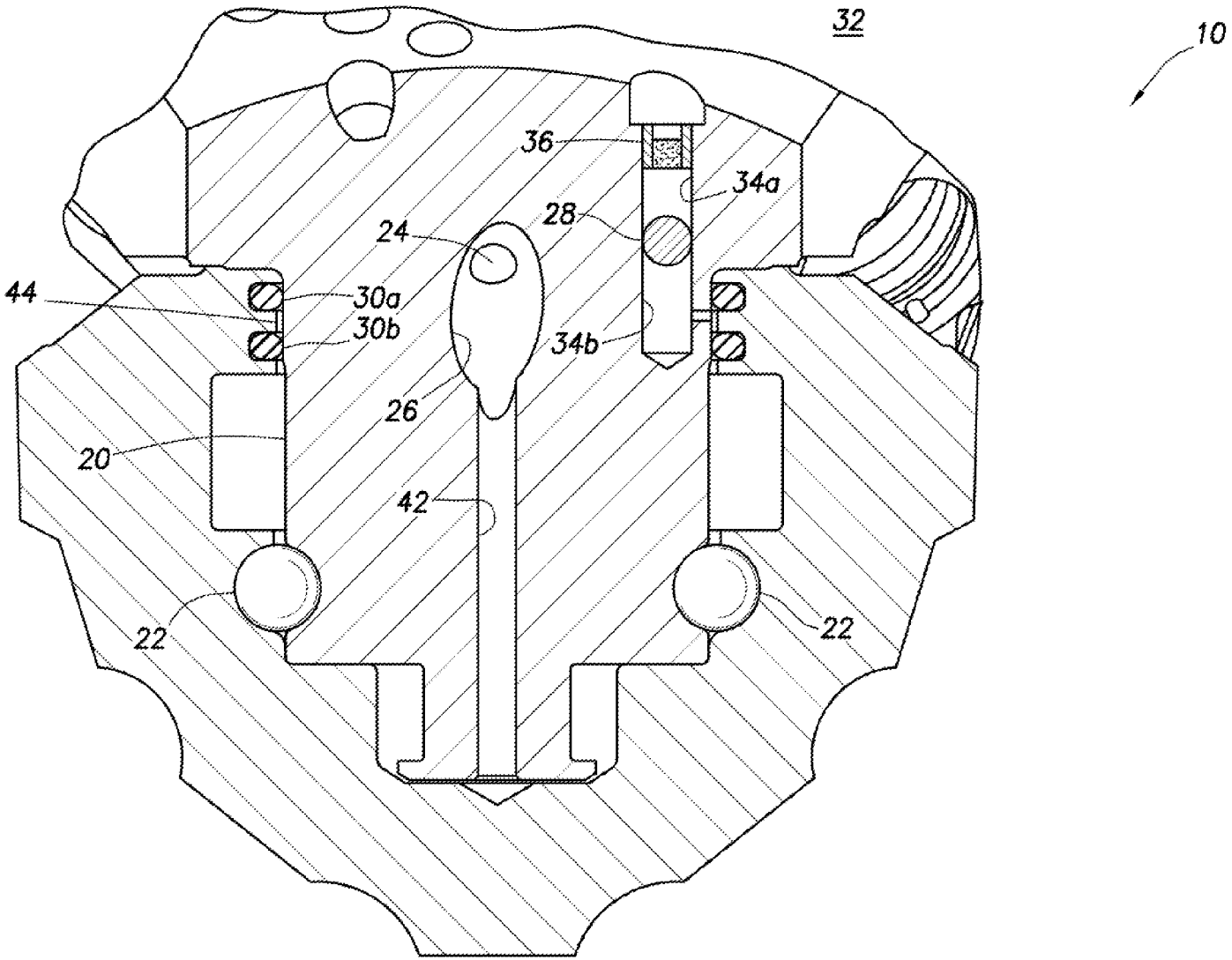

Referring additionally now to FIG. 6, another configuration of the drill bit 10 is representatively illustrated. In this configuration, the plug 28 and bore sections 34*a,b* are used to equalize pressure across the seal 30*a*. In particular, the bore section 34*b* is in fluid communication with the annular gap 44 between the seals 30*a,b*, and the bore section 34*a* is in fluid communication with the exterior 32 of the drill bit 10.

With the lubricant chamber 24 also pressure equalized with the exterior 32 of the drill bit 10 (e.g., as in the FIGS. 2 & 3 examples or using a conventional pressure equalization device), the result will be that pressure across each of the seals 30*a,b* is substantially equalized in the FIG. 6 example. Note that, in other examples, pressures exposed to the seals 30*a,b* could be equalized with pressure in the interior 40 of the drill bit 10 (for example, by providing fluid communication between the bore section 34*a* and the interior of the drill bit).

Figure 7:
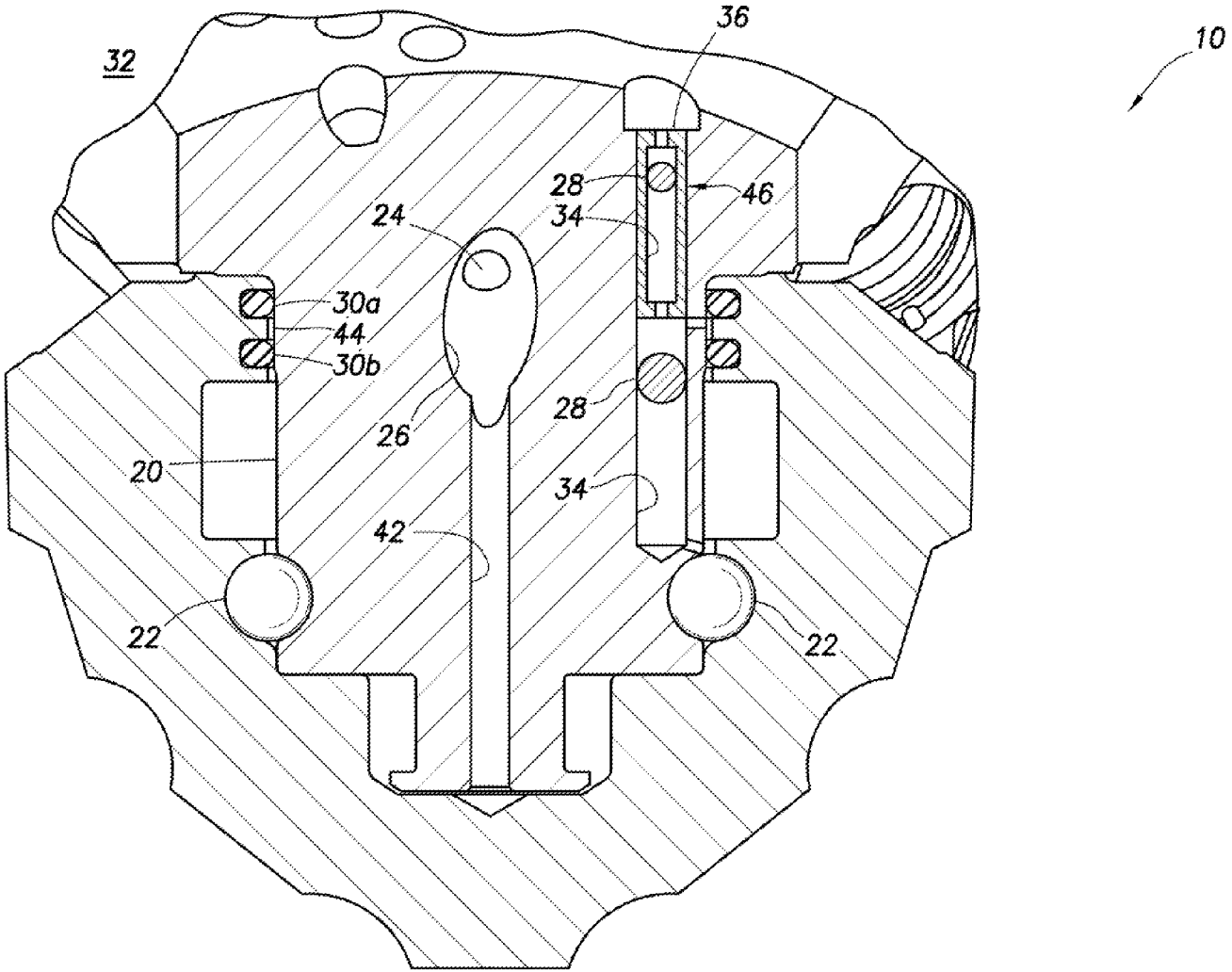

Referring additionally now to FIG. 7, another example of the drill bit 10 is representatively illustrated. This example is similar in many respects to the FIG. 5 example described above, but differs at least in that a second set 46 of plug 28 and bore 34 is used to equalize pressure between the exterior 32 and the annular gap 44 between the seals 30*a,b*.

Figure 8:
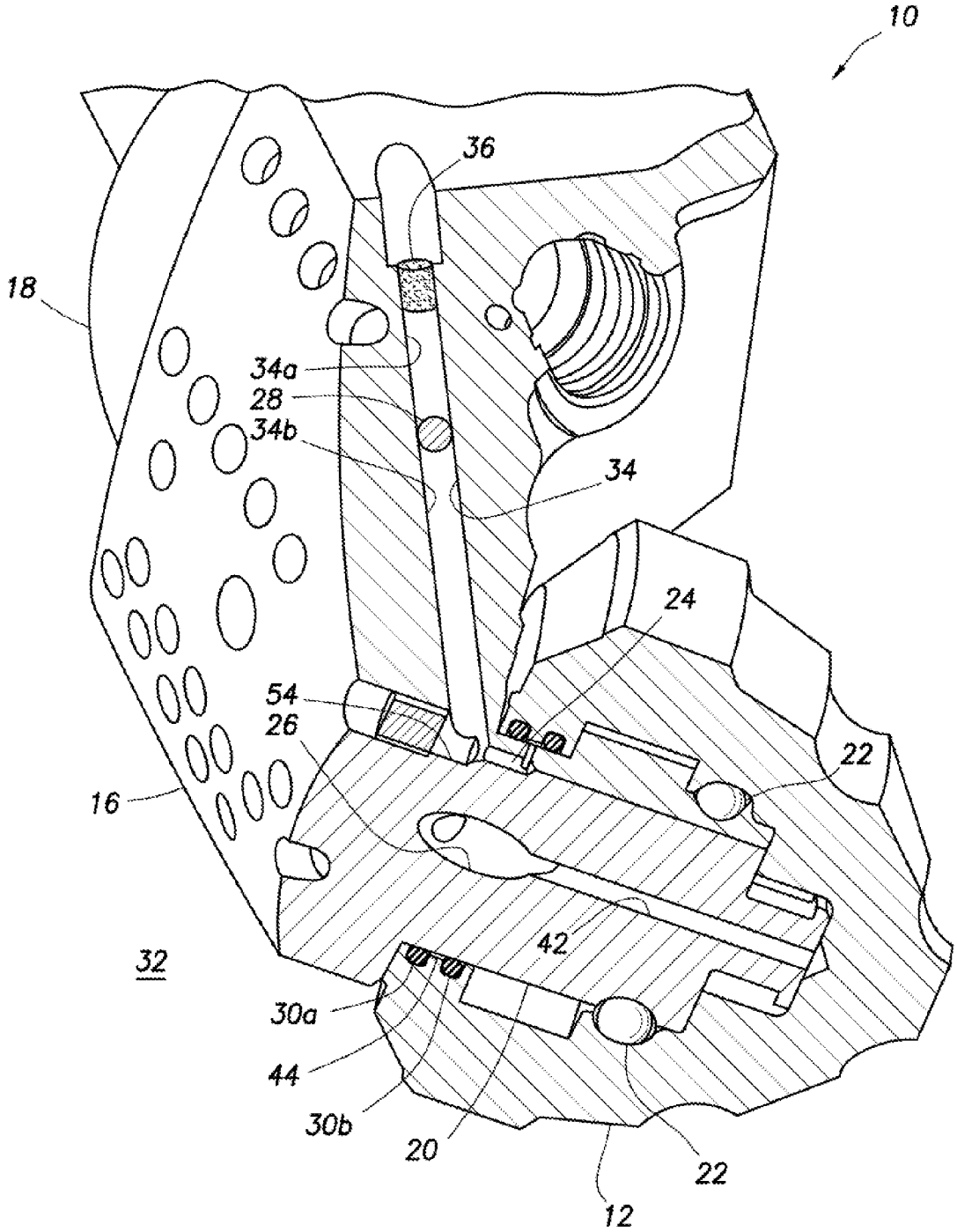

Referring additionally now to FIG. 8, another example of the drill bit 10 is representatively illustrated. In this example, a bore 34 extends through the arm 16, and a plug 28 is sealingly and reciprocably received in the bore. The bore section 34*a* is in fluid communication with the exterior 32 of the drill bit 10, and the bore section 34*b* is in fluid communication with the annular gap 44 between the seals 30*a,b*.

An enlarged bypass chamber 54 is provided at an end of the bore section 34*b*, in order to allow well fluid to bypass the plug 28, for example, in the event that there is excessive loss of lubricant from the lubricant chamber 24. As lubricant is lost from the chamber 24, the plug 28 displaces toward the bypass chamber 54 (e.g., the bore section 34*a* lengthens, and the bore section 34*b* shortens).

Eventually, the plug 28 enters the bypass chamber 54, and the well fluid can then flow around the plug. In this manner, pressure across the seals 30*a,b* can still be equalized, even though the plug 28 no longer isolates the lubricant from the well fluid.

Figure 9:
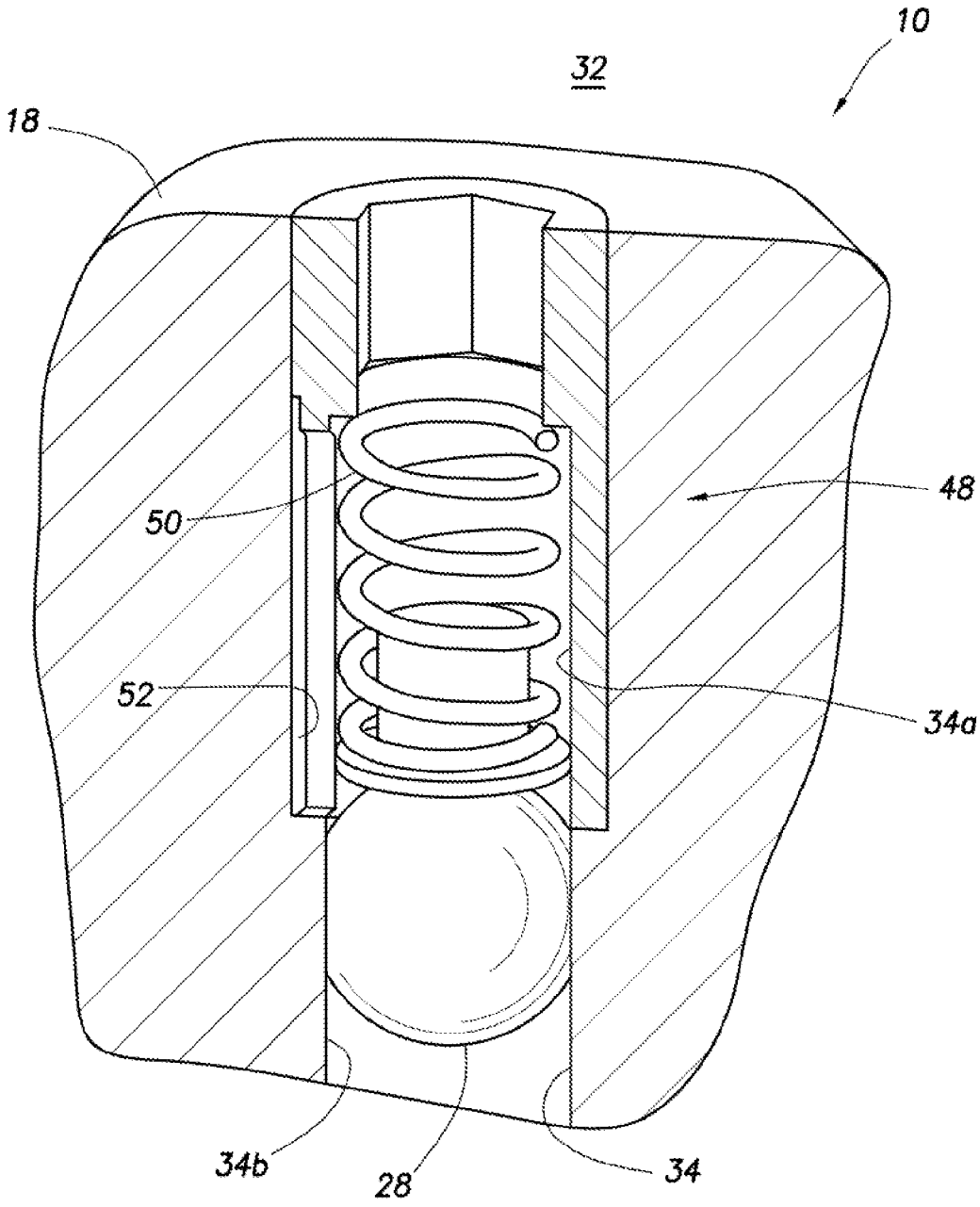
FIG. 9 is a representative cross-sectional view of a pressure relief valve which may be used in the drill bit, and which can embody principles of this disclosure.

Referring additionally now to FIG. 9, another configuration of the drill bit 10 is representatively illustrated, in which the plug 28 and bore 34 are used both to substantially equalize pressure between the bore section 34*b* and the exterior 32 of the drill bit, and as part of a pressure relief valve 48. The valve 48 includes the plug 28, a biasing device 50 (such as a spring, etc.) and an enlarged dimension or recess 52 which allows fluid to bypass the plug 28.

For example, the bore section 34*a* can be in fluid communication with the exterior 32 of the drill bit 10, and the bore section 34*b* can be in fluid communication with the lubricant chamber 24. If (for example, due to thermal expansion, etc.) there is excess pressure in the lubricant chamber 24, a pressure differential across the plug 28 will displace the plug against a biasing force exerted by the biasing device 50, until the plug has displaced sufficiently (or, until a predetermined pressure differential across the plug has been exceeded) for the lubricant to flow via the enlarged dimension or recess 52 to the exterior 32, thereby relieving the excess pressure in the chamber 24.

In one example, the pressure relief valve 48 could be incorporated into the configuration of FIG. 8 for equalizing the pressure across the seal 30*a*. The biasing device 50 and the recess 52 could, for example, be provided in the bore 34 of the FIG. 8 configuration, or of any of the other configurations described above.

Figure 10A:
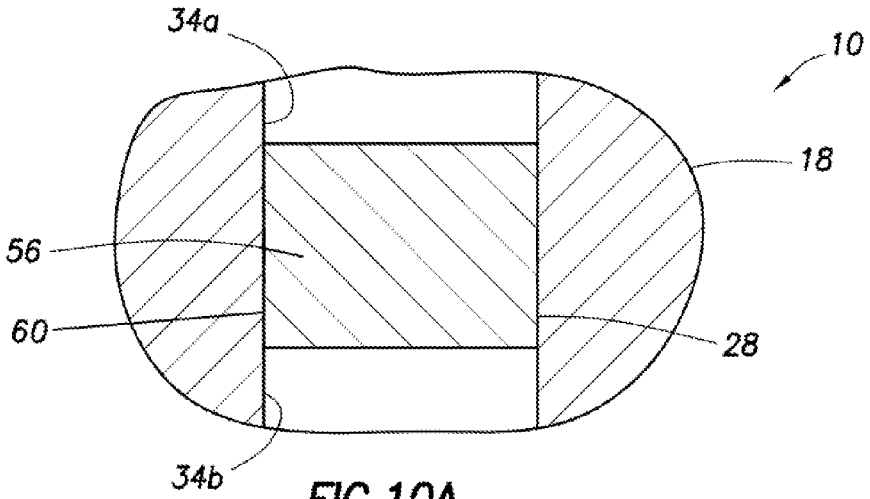
FIGS. 10A-C are representative cross-sectional views of different plugs which may be used in the drill bit.
Figure 10B:
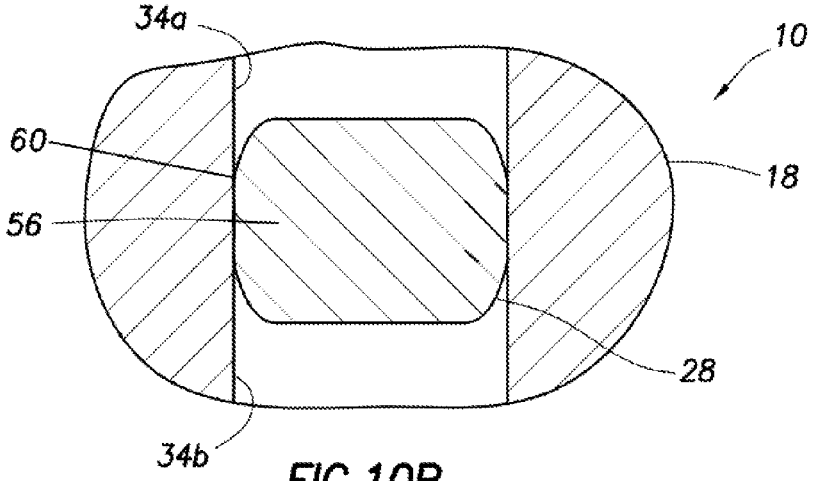
Figure 10C:
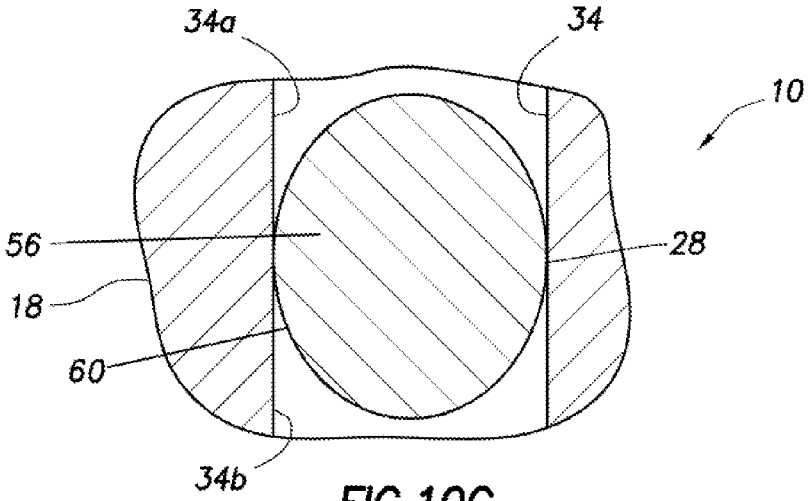

Referring additionally now to FIGS. 10A-C, examples of various different types of plugs 28 which may be used in the drill bit 10 are representatively illustrated. These are merely a few examples of a wide variety of different plugs which may be used, and so it should be clearly understood that the scope of this disclosure is not limited at all to only the specific shapes and types of plugs described herein and depicted in the drawings.

In FIG. 10A, the plug 28 is cylinder-shaped, and is made entirely of an elastomer sealing material 56 for sealingly engaging the bore sections 34*a,b*. In FIG. 10B, the plug 28 has a curved, parabolic-shaped outer surface for mitigating binding in the bore sections 34*a,b*. In FIG. 10C, the plug 28 has an elliptical-shaped outer surface.

Since the plug 28 examples of FIGS. 10A-C are made entirely of the elastomer sealing material 56, the plugs can sealingly engage the bore sections 34*a,b* anywhere on their outer surfaces 60. Of course, the cylindrical plug of FIG. 10A would not turn in the bore 34 for sealing engagement with its upper and lower sides, but the spherical plug of FIGS. 2-9 can turn any direction and maintain sealing engagement with the bore, since the sealing material 56 covers its entire outer surface 60.

It may now be fully appreciated that significant advancements are provided to the art by the disclosure above. In examples described above and shown in the drawings, pressures in a drill bit 10 can be substantially equalized with the exterior 32 or interior 40 of the drill bit using a floating plug 28 sealingly and reciprocably received in a bore 34.

More specifically, a drill bit 10 of the type used to drill a wellbore into the earth is described above. In one example, the drill bit 10 includes a bore 34 formed in the drill bit 10, and a plug 28 sealingly and reciprocably disposed in the bore 34. The plug 28 prevents fluid communication between first and second sections 34*a,b* of the bore 34 in the drill bit 10.

The plug 28 can comprise a sphere. The plug 28 may be spherically-shaped.

The plug 28 can comprise other shapes. The drill bit 10 may include a sealing material 56 on the plug, whereby the sealing material 56 sealingly engages a wall of the bore 34.

The first bore section 34*a* may be in fluid communication with an exterior 32 of the drill bit 10. The second bore section 34*b* can be in fluid communication with a lubricant chamber 24 in the drill bit 10, and/or an annular gap 44 between two seals 30*a,b*. The seals 30*a,b* may provide sealing engagement between a journal 20 and a cutting structure 58 (e.g., comprising cone 12 and cutting elements 14) which rotates about the journal 20.

The drill bit 10 can include a bypass chamber 54 which is enlarged relative to the bore 34, and which is in communication with the bore 34, whereby the plug 28 is displaceable into the bypass chamber 54. Fluid can bypass the plug 28 when the plug 28 is in the bypass chamber 54. The plug 28 may be displaceable into the bypass chamber 54 in response to loss of lubricant from the drill bit 10.

The drill bit 10 can include at least two seals 30*a,b* which seal off an annular gap 44. The annular gap 44 may be formed between a journal 20 and a cutting structure 58 which rotates relative to the journal 20.

The first bore section 34*a* may be in fluid communication with the annular gap 44 between the seals 30*a,b*. The second bore section 34*b* can be in fluid communication with the annular gap 44, and/or a lubricant chamber 24 in the drill bit 10.

One side of one of the seals 30*b* can be exposed to the annular gap 44 between the seals 30*a,b*. The second bore section 34*b* may be in fluid communication with the annular gap 44 on an opposite side of the one of the seals 30*b*.

Pressure in the first and second sections 34*a,b* of the bore 34 on respective first and second opposite sides of the plug 28 may be substantially equalized.

A biasing device 50 may bias the plug 28 toward a position in which fluid communication between the first and second sections 34*a,b* of the bore 34 is prevented. Fluid communication between the first and second sections 34*a,b* of the bore 34 may be permitted when a pressure differential across the plug 28 exceeds a predetermined level.

The plug 28 and bore 34 can be used to equalize pressures between various regions in and about the drill bit 10. For example, if a group comprises an interior 40 of the drill bit 10, an exterior 32 of the drill bit 10, a lubricant chamber 24 in the drill bit 10, and an annular gap 44 between seals 30*a,b* in the drill bit 10, the first and second sections 34*a,b* of the bore 34 can be in fluid communication with any respective different ones of the group, so that these different ones are pressure balanced.

The plug 28 can be made entirely or partially of an elastomer material 56. A sealing material 56 may completely cover an outer surface 60 of the plug 28.

In one example described above, a wellbore drill bit 10 can include a bore 34 formed in the drill bit 10, and a spherically-shaped plug 28 sealingly and slidingly disposed in the bore 34, whereby the plug 28 prevents fluid communication between first and second sections 34*a,b* of the bore 34 in the drill bit 10.

In another example described above, a wellbore drill bit 10 can include a bore 34 formed in a body 18 of the drill bit 10, and a floating plug 28 sealingly and reciprocably disposed in the bore 34, whereby pressure in first and second sections 34*a,b* of the bore 34 on respective first and second opposite sides of the plug 28 is substantially equalized.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A wellbore drill bit, comprising:

a bore formed in the drill bit; and a spherically-shaped plug disposed in the bore, the plug sealingly engaging and slidingly contacting the bore, whereby the plug permits pressure communication between first and second sections of the bore while preventing fluid communication between the first and second sections, wherein the first bore section is in fluid communication with an exterior of the drill bit, and wherein the second bore section is in fluid communication with an annular gap between two seals.

2. The drill bit of claim 1, wherein the seals provide sealing engagement between a journal and a cutting structure which rotates about the journal.

3. A wellbore drill bit, comprising:

a bore formed in the drill bit;

a spherically-shaped plug sealingly and slidingly disposed in the bore, whereby the plug permits pressure communication between first and second sections of the bore while preventing fluid communication between the first and second sections, wherein the plug slidingly contacts the bore; and at least two seals which seal off an annular gap, and wherein the first bore section is in fluid communication with the annular gap between the seals.

4. The drill bit of claim 3, wherein the second bore section is in fluid communication with the annular gap.

5. The drill bit of claim 3, wherein the second bore section is in fluid communication with a lubricant chamber in the drill bit.

6. The drill bit of claim 3, wherein one side of one of the seals is exposed to the annular gap between the seals, and wherein the second bore section is in fluid communication with the annular gap on an opposite side of the one of the seals.

7. The drill bit of claim 3, wherein the annular gap is formed between a journal and a cutting structure which rotates relative to the journal.

* * * * *

UNITED STATES PATENT AND TRADEMARK OFFICE

CERTIFICATE OF CORRECTION

PATENT NO. : 8,800,689 B2
APPLICATION NO. : 13/705658
DATED : August 12, 2014
INVENTOR(S) : Micheal B. Crawford It is certified that error appears in the above-identified patent and that said Letters Patent is hereby corrected as shown below:

Title page, Item 72, Inventor:, cancel "Michael" and insert in place thereof -- Micheal --.

Signed and Sealed this
Eleventh Day of November, 2014

Michelle K. Lee

Michelle K. Lee
*Deputy Director of the United States Patent and Trademark Office*